United States Patent [19]

Ohtani et al.

[11] 4,216,454

[45] Aug. 5, 1980

[54] PLUNGER-TYPE ELECTRO-MAGNETIC ACTUATOR

[75] Inventors: Yoshio Ohtani, Matsuyama; Todomu Kakishima, Fukuoka, both of Japan

[73] Assignee: Diesel Kiki Co., Ltd., Tokyo, Japan

[21] Appl. No.: 930,443

[22] Filed: Aug. 2, 1978

[30] Foreign Application Priority Data

Aug. 2, 1977 [JP] Japan ..... 52-92161

[51] Int. Cl.[2] ..... H01F 7/08

[52] U.S. Cl. ..... 335/262; 335/236; 335/255

[58] Field of Search ..... 335/251, 255, 258, 261, 335/262, 279, 236, 249, 260

[56] References Cited

U.S. PATENT DOCUMENTS

| | | | |
|---|---|---|---|
| 1,436,639 | 11/1922 | Bindschedler | 335/262 |
| 2,076,858 | 4/1937 | Morgenstern | 335/279 |
| 3,241,006 | 3/1966 | Boyko | 335/279 X |
| 4,114,125 | 9/1978 | Komatsu | 335/258 |

*Primary Examiner*—Harold Broome

*Attorney, Agent, or Firm*—Sughrue, Rothwell, Mion, Zinn and Macpeak

[57] ABSTRACT

The present invention is a plunger-type electro-magnetic actuator which produces a constant attracting force regardless of the position of the plunger. A tip portion of the plunger is tapered and a magnetic pole piece of the solenoid adapted to electro-magnetically attract the tip portion is provided with a tapered hole having a diameter larger than the outer diameter of the plunger. An additional magnetic pole piece is substantially displaced from the magnetic pole piece along the advancing direction of the plunger so as to increase the operational range of the plunger.

8 Claims, 3 Drawing Figures

PLUNGER-TYPE ELECTRO-MAGNETIC ACTUATOR

BACKGROUND OF THE INVENTION

1. Field of the Invention

The present invention relates to a plunger-type electromagnetic actuator for use in an electronic governor of an internal combustion engine.

2. Description of the Prior Art

A plunger-type electro-magnetic actuator is adapted to function as an electric-mechanical converter to control the movement of a fuel control rod in a electronic governor of an internal combustion engine. conventionally, a spring-biased plunger is movably disposed in an electro-magnetic solenoid. The position of a fuel control rod connected to the plunger is determined by the resultant of the forces produced by the spring and by the exciting current provided to the solenoid winding. However, as shown in FIG. 1, the electro-magnetic attraction force F applied to the plunger due to the current flowing in the solenoid winding is approximately inversely proportional to the square of the distance X between the plunger and a magnetic pole piece, even if the exciting current provided to the solenoid winding is maintained constant. Due to this relationship, the exciting current should be accurately controlled when the distance X is small. However, such accurate current control is extremely difficult to achieve so as to control accurately the position of the fuel control rod throughout the range of travel. One approach to achieve the desired accuracy in positional control of the fuel control rod within a predetermined range is to locate the range in the region where the attracting force is at a low level, i.e., the gap length X is large. To do so, however, would make it difficult to provide a compact structure, and also the exciting current becomes large per unit of attraction force.

SUMMARY OF THE INVENTION

It is therefore an object of the present invention to overcome the above-mentioned deficiencies and to provide an improved electro-magnetic actuator.

Another object of the present invention is to provide, in an electro-magnetic actuator of the type having a plunger adapted to drive a member to be controlled, an electromagnetic solenoid having a first and a second magnetic pole pieces and having the plunger slidably inserted therethrough, and biasing spring for urging the plunger in the direction opposite to the second magnetic pole piece, the position of the plunger being controlled by an exciting current flowing in the electro-magnetic solenoid, the following improvements. A tapered tip portion is formed along the end portion of the plunger in the direction of the second magnetic pole piece. The tapered hole formed in the second magnetic pole piece has a diameter that is larger than that of the plunger such that the tip portion passes freely therethrough. A third magnetic pole piece is provided in a spaced apart relationship on the side of the second magnetic pole piece away from the first magnetic pole piece. The tapered hole is covered by the third magnetic piece. The present invention further includes a bobbin having an electromagnetic coil of the electro-magnetic solenoid wound therearound. The bobbin is made of a non-magnetic material selected form the group consisting of aluminum and austenitic stainless steel subjected to a hard surface treatment. The bobbin has a bore allowing the plunger to be slidable inserted therethrough. In addition, the diameter of the tapered hole formed in the magnetic pole piece can be greater on the side facing the first magnetic pole piece, and the third magnetic pole piece can be provided with a hole having a diameter greater than the diameter of the member to be controlled. The present invention thus produces a constant attracting force regardless of the position of the plunger.

DETAILED DESCRIPTION OF THE INVENTION

Figure 2:
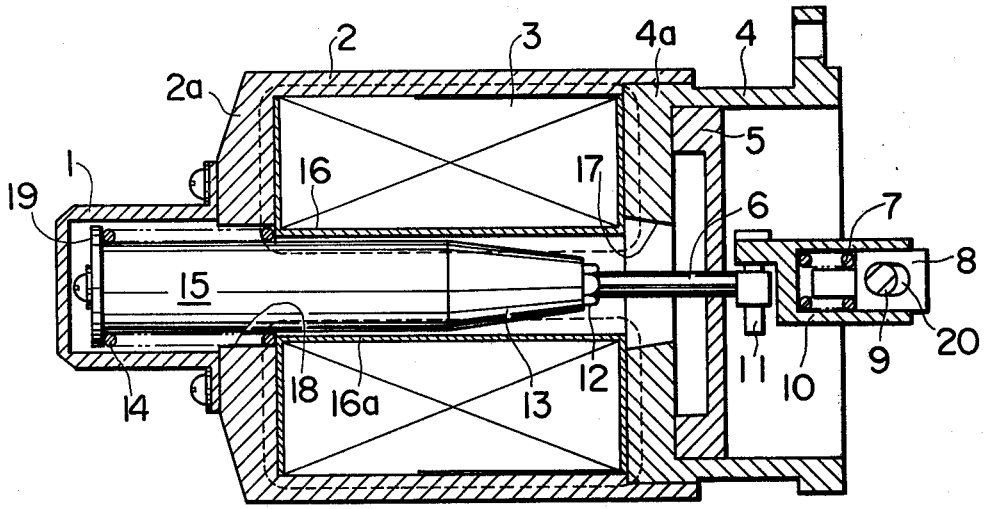
FIG. 2 is a side view partially in cross-section showing the plunger-type electro-magnetic actuator according to the present invention.
Figure 1:
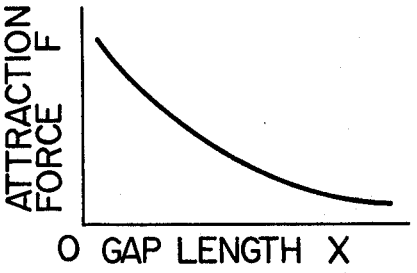
FIG. 1 is a graph plotting the relationship between the plunger attracting force F on the vertical axis versus the gap length X on the horizontal axis.

The present invention is now described in detail with reference to FIG. 2, wherein a cup-shaped yoke 2 houses a bobbin 16 made of non-magnetic material around which electro-magnetic coil 3 is wound. The closed end wall of yoke 2 functions as a first magnetic pole piece 2*a*, while the open end thereof is closed by a cup-shaped cylinder 4 whose bottom end wall functions as a second magnetic pole piece 4*a*. A hole 18 is formed in a first magnetic pole piece 2*a* to allow reciprocating movement of a plunger 15 therethrough. The plunger 15 is slidingly engaged along a bore 16*a* of the bobbin 16. The bore 16*a* is made of non-magnetic material, such as, aluminum and austenitic stainless steel subjected to a hard surface treatment. The plunger 15 is provided with a flange 19 at the rear end thereof to which one end of a coil spring 14 is secured. The other end of the coil spring 14 is secured to the rear end of the bobbin 16 so that the plunger 15 is normally biased toward the rear end thereof. The flange and the rear portion of the plunger 15 are covered with a cover 1 made of non-magnetic material secured to the first magnetic pole 2*a*.

A tip end 13 of the plunger 15 is provided with a taper, and at the small diameter end of the taper a rod member 6 is threadingly engaged therein and is fixedly secured thereto by a nut 12. The other end of the rod 6 is connected to a member to be controlled, such as, for example, a fuel control rod (not shown). The cylinder 4 is fixed, for example, to a main body of a governor (not shown) as disclosed in U.S. application Ser. Nos. 750,321 and 695,717. The second magnetic pole piece 4*a* is formed with a tapered hole 17 whose diameter is larger than the diameter of the plunger 15. The tapered hole 17 provides a sufficient gap when the tapered tip portion 13 of the plunger 15 passes therethrough. A third magnetic pole piece 5 is fitted in an inner peripheral surface of the cylinder 4 at a position spaced apart from the second magnetic pole piece 4*a* so as to cover the tapered hole 17.

In the embodiment shown in FIG. 2, the rod 6 is connected to a cylindrical member 10 by means of a pin 11. At an interior of the cylindrical member 10, a piston 8 is slidably fitted. The piston 8 is provided with a slot 20 with which a pin 9 secured to the cylindrical member 10 is fitted. A correcting spring 7 is interposed between the bottom of the cylindrical member 10 and the piston 8. The piston 8 is urged frontwardly by the biasing force of the spring 7 to a position defined by the engagement of the pin 9 with the rear end of the slot 20. The piston 8 is connected to a fuel control rod (not shown) to provide thereby in electro-governor for use in an internal combustion engine.

In operation, an electric current is provided to the electro-magnetic coil 3. The current so provided is proportional to the operating amount of the member to be controlled. For example, in case of the electro-governor, the electric current is in proportion to the rotational differential between the engine rotation speed corresponding to the accelerating pedal position and the actual engine rotation speed. A magnetic field, as indicated by the broken line, is generated in the magnetic pole pieces 2*a*, 4*a*, 5 and the plunger 15, each made of magnetic material, due to the electric current flowing in the electro-magnetic coil 3, so that the plunger 15 is subject to an attraction force which acts to reduce the distance between the magnetic pole piece 4*a* and the plunger 15. That is, the plunger 15 is subject to an attraction force in a direction toward the right, as referenced to FIG. 2, in proportion to the electric current flowing in coil 3, and is maintained at a position at which the rightward attracting force is balanced with respect to the leftward biasing force produced by spring 14.

According to the present invention, since the tip end 13 of the plunger 15 is tapered, and since the tapered hole 17 of the second magnetic pole piece 4*a* has a larger diameter than that of the plunger 15, the gap between the tapered hole 17 and the plunger 15 is gradually reduced as the plunger 15 is displaced toward the right, with reference to FIG. 2. Therefore, the differerential of the plunger urging force provided by the electromagnetic coil 3 relative to the rightward displacement of the plunger 15 can be small, which results in a proportional relationship being produced between the amount of displacement of plunger 15 and the electric current value flowing in the electro-magnetic coil 3.

When the tapered tip 13 of plunger 145 is passed through the tapered hole 17, the movement of the plunger 15 is determined by the gap defined between the tip of the plunger 15 and the third magnetic pole piece 5. In this case, a magnetic force produced by the looped magnetic field in the third magnetic pole piece 5 is arranged to be lower than the magnetic force caused by the magnetic field present in the second magnetic pole piece 4*a*. Thus, when plunger 15 is displaced from the position shown in FIG. 2 to the position where the tip 13 abuts against the third magnetic pole piece 5, i.e., maximum moving length of the plunger, the plunger 15 is subjected to a substantially constant attraction force, as shown by curves b through d in FIG. 3.

With the structure thus described, the electro-magnetic actuator permits mechanical displacement of the plunger in proportion to the accelerating pedal displacement amount so as to obtain the desired control of the fuel control rod.

Because the bobbin 16 is made of a non-magnetic material, such as, aluminum and austenitic stainless steel subjected to a hard surface treatment, the sliding portion defined between the bore 16*a* and the plunger 15 ensures sliding movement of the plunger 15, and excellent thermal resistance lubricating properties are also provided thereby.

Figure 3:
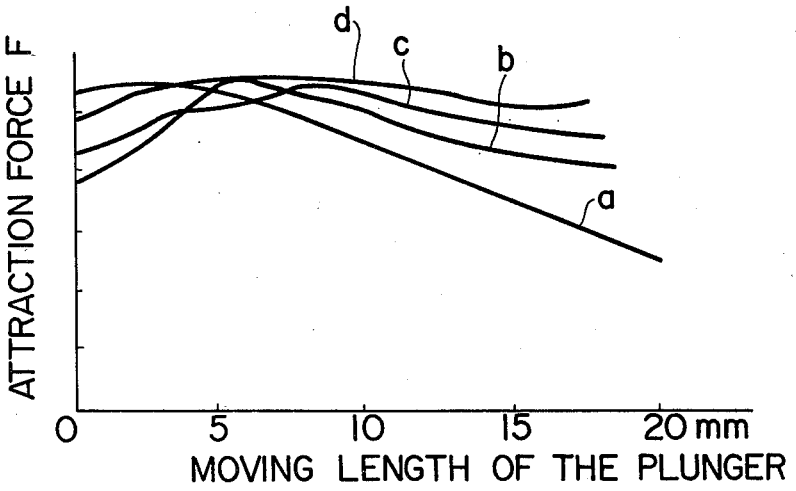
FIG. 3 is a graph plotting the relationship between the attracting force F applied to the plunger on the vertical axis with respect to the moving position of the plunger on the horizontal axis.

In FIG. 3, curve a shows a relationship between the moving length of the plunger and a attraction force F wherein the third magnetic pole piece 5 is not used, while curves b through d show the relationship wherein the third magnetic pole piece 5 is employed. The maximum stroke of the plunger 15 is set to be 20 mm. In the curve a, when the tapered tip 13 of plunger 15 is through the tapered hole 17, the attraction force applied to the plunger 15 is immediately reduced provided that the electric current flowing in the electro-magnetic coil 3 is constant. This is due to the fact that on passing the tip 13 through the hole 17, the magnetic field becomes saturated. Further investigation reveals that in the region where the attraction force is reduced in the conventional devices, stabilized movement of the plunger is not obtainable because a hysterisis is produced due to current flow change in the electro-magnetic coil. In contrast, according to the present invention, as shown in curves b and d, when the plunger 15 is passing through the tapered hole 17, the attraction force is supplemented by the third magnetic pole piece 5, whereby the plunger 15 is subject to a substantially constant attraction force along its entire stroke length. It should be noted that the attraction force can be maintained substantially constant at the maximum stroke side, i.e., at the most advanced position of the plunger 15, by enlarging the distance between the second and the third magnetic pole pieces 4*a* and 5.

What is claimed is:

1. An electro-magnetic actuator of the type having a plunger adapted to drive a member to be controlled, an electromagnetic solenoid having a first and a second magnetic pole pieces and having said plunger slidably inserted therethrough, and a biasing spring for urging said plunger in the direction opposite to said second magnetic pole piece, the position of said plunger being controlled by an exciting current flowing in said electro-magnetic solenoid, wherein the improvement comprises:

(a) a tapered tip portion formed along the end portion of said plunger in the direction of said second magnetic pole piece;

(b) a tapered hole formed in said second magnetic pole piece, the minimum diameter of said tapered hole being larger than the maximum diameter of said plunger such that said tip portion passes freely therethrough; and (c) a third magnetic pole piece disposed at the side of said second magnetic pole piece, away from said first magnetic pole piece, said third magnetic pole piece spaced apart from said second magnetic pole piece, said tapered hole of said second magnetic pole piece being covered by said third magnetic pole piece.

2. The electro-magnetic actuator as recited in claim 1, wherein an electro-magnetic coil of said electro-magnetic solenoid is wound around a bobbin made of non-magnetic material selected from the group consisting of aluminum and austenitic stainless steel subjected to a hard surface treatment, said bobbin having a bore allowing said plunger to be slidably inserted therethrough.

3. The electro-magnetic actuator as recited in claim 1, wherein an electro-magnetic coil of said electro-magnetic solenoid is wound around a bobbin made of non-magnetic material selected from the group consisting of aluminum and austenitic stainless steel subjected to a hard surface treatment, said bobbin having a bore allowing said plunger to be slidably inserted therethrough.

4. The electro-magnetic actuator as recited in claim 1, wherein the diameter of said tapered hole formed in said magnetic pole piece is greater on the side facing said first magnetic pole piece.

5. The electro-magnetic actuator as recited in claim 1, wherein the diameter of said tapered hole formed in said magnetic pole piece is greater on the side facing said first magnetic pole piece.

6. The electro-magnetic actuator as recited in claim 1, wherein said third magnetic pole piece is provided with a hole having a diameter greater than the diameter of said member to be controlled, the center line of said hole being substantially coincident with the center line of said tapered hole formed in said magnetic pole piece.

7. The electro-magnetic actuator as recited in claim 3, wherein said third magnetic pole piece is provided with a hole having a diameter greater than the diameter of said member to be controlled, the center line of said hole being substantially coincident with the center line of said tapered hole formed in said magnetic pole piece.

8. The electro-magnetic actuator as recited in claim 5, wherein said third magnetic pole piece is provided with a hole having a diameter greater than the diameter of said member to be controlled, the center line of said hole being substantially coincident with the center line of said tapered hole formed in said magnetic pole piece.

* * * * *